US011826003B2

(12) United States Patent
Schiele et al.

(10) Patent No.: US 11,826,003 B2
(45) Date of Patent: Nov. 28, 2023

(54) DISHWASHER, METHOD FOR OPERATING A DISHWASHER, AND COMPUTER PROGRAM PRODUCT

(71) Applicants: BSH Hausgeräte GmbH, Munich (DE); Reckitt Benckiser (Brands) Limited, Slough (GB)

(72) Inventors: Alexander Schiele, Herbrechtingen (DE); Jakob Schultz, Dillingen (DE); Georg Walther, Munich (DE); Daniel Miller, Finningen (DE); Alberto Buogo, Lincoln (GB); Addie Muentzenberger, Heidelberg (DE); Anne-Katrin Späte, Heidelberg (DE)

(73) Assignee: BSH Hausgeräte GmbH, Munich (DE)

( * ) Notice: Subject to any disclaimer, the term of this patent is extended or adjusted under 35 U.S.C. 154(b) by 332 days.

(21) Appl. No.: 17/269,275

(22) PCT Filed: Aug. 28, 2019

(86) PCT No.: PCT/EP2019/073015
§ 371 (c)(1),
(2) Date: Feb. 18, 2021

(87) PCT Pub. No.: WO2020/043800
PCT Pub. Date: Mar. 5, 2020

(65) Prior Publication Data

US 2021/0251465 A1 Aug. 19, 2021

(30) Foreign Application Priority Data

Aug. 29, 2018 (DE) ..... 102018214644.6

(51) Int. Cl.
*A47L 15/00* (2006.01)
*A47L 15/44* (2006.01)

(52) U.S. Cl.
CPC ..... *A47L 15/449* (2013.01); *A47L 15/0055* (2013.01); *A47L 15/4409* (2013.01);
(Continued)

(58) Field of Classification Search
None
See application file for complete search history.

(56) References Cited

U.S. PATENT DOCUMENTS

2009/0199881 A1 8/2009 Deweerd et al.
2011/0000511 A1 1/2011 Mersch et al.

FOREIGN PATENT DOCUMENTS

DE 2501969 A1 7/1976
DE 102008036588 A1 2/2010
EP 2277431 A2 1/2011

OTHER PUBLICATIONS

International Search Report PCT/EP2019/073015 dated Dec. 19, 2019.

*Primary Examiner* — Levon J Shahinian
(74) *Attorney, Agent, or Firm* — Michael E. Tschupp; Andre Pallapies; Brandon G. Braun

(57) ABSTRACT

A household dishwasher includes a washing chamber, a control apparatus for running a washing program from a number of washing programs, a metering system having a supply unit for receiving an individual dose of a first cleaning agent and supplying the individual dose into the washing chamber at a metering point in time while running the washing program, and an automatic metering apparatus for automatically metering a plurality of metering quantities from a supply of a second cleaning agent in the form of a solid material into the washing chamber at the metering point in time, and a sensor apparatus configured to detect a state of the metering system and to emit a sensor signal depending on the detected state of the metering system. The
(Continued)

control apparatus runs the washing program depending on the sensor signal.

8 Claims, 2 Drawing Sheets

(52) U.S. Cl.
CPC ..... *A47L 15/4418* (2013.01); *A47L 15/4463* (2013.01); *A47L 2401/02* (2013.01); *A47L 2401/023* (2013.01); *A47L 2501/07* (2013.01); *A47L 2501/26* (2013.01)

DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2019/073015, filed Aug. 28, 2019, which designated the United States and has been published as International Publication No. WO 2020/043800 A1 and which claims the priority of German Patent Application, Serial No. 10 2018 214 644.6, filed Aug. 29, 2018, pursuant to 35 U.S.C. 119(a)-(d).

BACKGROUND OF THE INVENTION

The present invention relates to a household dishwasher, a method for operating a household dishwasher and a computer program product.

Household dishwashers which have a metering apparatus which may be loaded with a supply of cleaning agent are known, wherein a suitable quantity of the cleaning agent is dispensed by program control while running a washing program. This has the advantage that a user does not have to fill a supply unit with cleaning agent before running each washing program.

It may be provided that a household dishwasher has both the metering apparatus and the supply unit. The problem then arises that it is unclear to the user which of the two systems is currently being used.

BRIEF SUMMARY OF THE INVENTION

In view of this background to the invention, an object of the present invention is to provide an improved household dishwasher.

According to a first feature, a household dishwasher is proposed, comprising a washing chamber, a control apparatus for running a washing program from a number of washing programs, and a metering system comprising a supply unit for receiving an individual dose of a first cleaning agent and for supplying the individual dose into the washing chamber at a metering point in time while running the washing program and comprising an automatic metering apparatus for automatically metering a plurality of metering quantities from a supply of a second cleaning agent provided as a solid material into the washing chamber at a metering point in time. A sensor apparatus is provided for detecting the state of the metering system and emitting a sensor signal depending on the detected state of the metering system. The control apparatus is designed to run the washing program depending on the sensor signal.

The proposed household dishwasher has the advantage that it is possible for a user to use the metering system, comprising both the supply unit and the automatic metering apparatus, in an intuitive manner without complicated program steps being required. As a result, firstly a user experience is improved and secondly an efficiency of the dishwasher is increased since incorrect operation of the dishwasher is avoided.

The control apparatus may be implemented by hardware technology and/or software technology. In the case of implementation by hardware technology, the control apparatus may be configured, for example, as a computer or as a microprocessor. In the case of implementation by software technology, the control apparatus may be configured as a computer program product, as a function, as a routine, as part of a program code or as an object which may be executed. The control apparatus is designed to run a washing program from a number of washing programs. The number of washing programs may be stored, for example, on a memory unit assigned to the control apparatus. The running of a washing program may also be denoted as a washing cycle. For running the respective washing program the control apparatus controls or activates the respectively provided functional units of the household dishwasher, such as for example a valve, a pump, a heating unit and/or the metering system, according to the washing program.

The metering system comprises, in particular, a supply unit which is arranged, for example, on an inner face of a door of the household dishwasher. In the opened state of the door, the supply unit is easily accessible to the user. For example, the supply unit has a container which may be closed by a flap and which is designed to receive a quantity of the first cleaning agent. In this case, the first cleaning agent may be provided in the form of a powder, in the form of pellets, in the form of a tablet or even as a liquid. In this case, when filling the container, the user controls the quantity of the first cleaning agent which is supplied as the individual dose while running the washing program. In this case, the maximum quantity is predetermined, in particular, by the volume of the container. After the filling procedure, the user closes the container of the supply unit with the flap. At the metering point in time, for example, the control apparatus activates the supply unit so that the flap is opened and the individual dose is dispensed into the washing chamber of the household dishwasher. A metering point in time is understood, in particular, as a point in time during the course of the washing program at which cleaning agent is to be supplied. This point in time is, for example, at the start of a cleaning sub-program step.

Such a supply unit has the advantage that the user has full control over which quantity and which type of the first cleaning agent are used when running the next washing program.

The metering system also has an automatic metering apparatus. This metering apparatus is advantageously designed to receive a supply of a second cleaning agent. The second cleaning agent is provided, in particular, as a solid material. For example, the second cleaning agent may be provided as a powder, as pellets, as tablets and/or in the form of shaped bodies consisting of cleaning agent. The second cleaning agent is, in particular, pourable or even free-flowing. The first cleaning agent and the second cleaning agent may be identical but they may also be different. The supply comprises a quantity of the second cleaning agent, which comprises a plurality of metering quantities. A metering quantity is, in particular, the quantity which is sufficient for a washing cycle in the case of washing items which range from being slightly soiled to having a normal level of soiling. The supply comprises, for example, 20 metering quantities, advantageously up to 50 metering quantities. The supply may advantageously be stored in a removable storage container. This storage container may thus be removed, for example, for refilling and/or may be replaced in a simple manner by a prefilled storage container.

The cleaning agent is understood in the present case, in particular, as a chemically active cleaning agent. The cleaning agent may also be a softening agent or comprise such a softening agent. The first or the second cleaning agent may also comprise a chemically inactive substance, such as for example an abrasive agent.

For metering the metering quantity, the automatic metering apparatus comprises, for example, a metering unit which is designed to remove the metering quantity of the second cleaning agent from the supply or the storage container, and to supply this metering quantity to the washing chamber of the household dishwasher. The metering quantity comprises, for example, 1-20 ml or 1-20 g of the second cleaning agent. In particular, when using the automatic metering apparatus, it is possible to provide a plurality of metering points in time in one washing program so that at any point in time the optimal quantity of cleaning agent is present in a washing liquor.

On the one hand, the supply unit and the automatic metering apparatus may be used alternatively to one another, wherein the user has the freedom of choice to use the supply unit or the automatic metering apparatus. On the other hand, the supply unit and the automatic metering apparatus complement one another since, for example, the second cleaning agent of the automatic metering apparatus comprises a standard cleaning agent which is suitable for cleaning daily occurring washing items. Thus the supply unit may be used for the application of a special cleaning agent as the first cleaning agent, when particular requirements for the cleaning of the washing items are set, such as for example a particular condition of the washing items and/or a particular condition of the soiling of the washing items.

The sensor apparatus for detecting the state of the metering system comprises, for example, optical, acoustic, electrical, mechanical and/or chemical sensors. For example, it is possible to provide an electrical contact for detecting an inserted storage container, an acoustic and/or mechanical sensor for detecting a filling state of the second cleaning agent in the storage container, an optical sensor for detecting the presence of the first cleaning agent in the container of the supply unit and/or a chemical sensor for detecting a type of the first cleaning agent in the container of the supply unit.

The state of the metering system relates, in particular, to the presence of the first cleaning agent and of the second cleaning agent. For example, a state may be defined by there being no first cleaning agent in the supply unit and a supply of 250 ml of the second cleaning agent being available to the automatic metering apparatus.

The sensor apparatus is designed to emit the detected state as a sensor signal. The control apparatus is designed to receive the sensor signal and to run the washing program depending on the sensor signal. In particular, the control apparatus is designed to determine the state of the metering system from the sensor signal, for example by an evaluation of the sensor signal. For example, the control apparatus determines from the sensor signal that the metering system is in the state in which there is no first cleaning agent in the supply unit and a supply of 250 ml of the second cleaning agent is available to the automatic metering apparatus. Thus the control apparatus will run the washing program, for example, such that at the metering point in time the automatic metering apparatus is activated for metering the metering quantity into the washing chamber of the household dishwasher. Alternatively, it may also be provided that the control apparatus selects and runs a specific washing program from the number of washing programs depending on the sensor signal. A specific washing program, for example, in particular when using the automatic metering apparatus, may have a plurality of metering points in time. It may also be provided that the metering points in time are dynamically generated and/or a metered quantity of the second cleaning agent may be adapted as required. The metered quantity may be set, for example, by adapting the metering quantity or, in particular, when the metering quantity has a fixed value, by repeated metering. In this manner, a washing result may be optimized.

For example, it may be provided that the control apparatus preferably deploys the supply unit when the supply unit is filled with an individual dose of the first cleaning agent. This may be denoted, for example, as "manual override".

According to one embodiment of the household dishwasher, the state of the metering system comprises a manual state and an automatic state, wherein in the manual state the individual dose of the first cleaning agent is present in the supply unit and in the automatic state at least one metering quantity of the second cleaning agent is present in the supply and no first cleaning agent is present in the supply unit. The control apparatus is designed to activate the supply unit for supplying the first cleaning agent at the metering point in time while running the washing program and/or to activate the automatic metering apparatus for metering the metering quantity of the second cleaning agent when the metering system is in the manual state and to activate the automatic metering apparatus for metering the metering quantity of the second cleaning agent when the metering system is in the automatic state.

In this embodiment it may be advantageously provided that the supply unit is always used when the user fills the individual dose of the first cleaning agent into the supply unit before the start of the washing cycle. This facilitates the use of the dishwasher and avoids incorrect operation. In particular, it is not necessary to program the dishwasher, for example, by actuating an option switch. In addition to this example, many other applications of the control apparatus are also possible depending on the state of the metering system.

For detecting the manual state, the sensor apparatus is designed, for example, to identify whether the first cleaning agent is present in the supply unit. If the first cleaning agent is present, then the metering system is in the manual state. If the first cleaning agent is not present, then the metering system is not in the manual state. For example, in a particularly simple embodiment the automatic state may already be deduced from the detection of the manual state: if the metering system is not in the manual state then the metering system is in the automatic state. In this embodiment, the sensor apparatus may be constructed in a particularly simple manner.

Preferably, for detecting the automatic state the sensor apparatus is also designed, for example, to identify whether at least one metering quantity of the second cleaning agent is present. If the supply of the second cleaning agent comprises at least the metering quantity, and the metering system is not in the manual state, then the metering system is in the automatic state. If the at least one metering quantity of the second cleaning agent is not present, then the metering system is not in the automatic state.

If the automatic metering apparatus is designed for removably receiving a storage container, alternatively the presence of the storage container in the automatic metering apparatus may be taken into account. Thus the metering system is in the automatic state, for example, when the storage container is inserted and no first cleaning agent is present in the supply unit. In particular, in this case it may be provided that a filling state of the second cleaning agent in the storage container is not taken into consideration.

Additionally or alternatively, the sensor apparatus may be designed to detect a filling state of the second cleaning agent in the storage container. The filling state may be detected, for example, relative to a maximum filling state in terms of percentage, or even detected in absolute terms as a weight or a volume of the second cleaning agent. If a filling state which is not zero is identified, then the presence of the storage container is implicitly identified thereby. On the other hand, a filling state of zero may mean both the absence of the storage container in the automatic metering apparatus and that the storage container is inserted but no more second cleaning agent is present, i.e. the storage container is empty.

According to a further embodiment of the household dishwasher, a user interface is provided for emitting user information depending on the sensor signal.

In this embodiment, for example, the user may be informed relative to the state of the metering system. Thus the user may adapt the programming of the household dishwasher, if desired. In particular, if the metering system is neither in the manual state nor in the automatic state, the user may be informed that neither the first cleaning agent nor the second cleaning agent is present.

The user information may comprise, in particular, not only the detected state of the metering system in the above-described sense but also other information. In particular, this information may include a filling state of the supply or the storage container, an instruction for filling the supply or for replacing and/or filling the storage container, ordering information for reordering a filled storage container or even a message that a specific cleaning agent should be filled as the first cleaning agent into the supply unit, since a specific washing program, for example for washing items made of stainless steel, has been selected. In this regard, facts going beyond the sensor signal, such as for example a preselection of the washing program by the user, may be taken into consideration for emitting the user information.

The user interface comprises, for example, a display on a front face of the household dishwasher and/or a data interface, in particular for wireless data transmission, such as for example WLAN, Bluetooth® and/or a mobile radio interface. By means of a data interface the user information may be transmitted, for example, to a connected device of the user, for example a mobile device such as a smartphone or a tablet and correspondingly emitted from the device.

According to a further embodiment of the household dishwasher, the automatic metering apparatus has a receiving unit for receiving a removable storage container for storing the second cleaning agent and the sensor apparatus is designed to detect a presence of the storage container in the automatic metering apparatus and/or a filling state of the second cleaning agent in the storage container.

For example, the sensor apparatus may have a mechanical or electrical switch for detecting whether the storage container is present. For detecting the filling state, for example, a weight of the storage container may be detected and/or an acoustic resonance frequency of the cavity in the storage container may be detected and/or an intensity attenuation, for example of infrared light, may be detected.

According to a further embodiment of the household dishwasher, the sensor apparatus is designed to detect a type of the first cleaning agent and/or a type of the second cleaning agent and the control apparatus is designed to run the washing program depending on the detected type of the first cleaning agent and/or the second cleaning agent.

The type of cleaning agent is understood to be, for example, a chemical composition, an administrable form, whether liquid or solid, and/or a preferred washing program for the use of the cleaning agent. For example, the sensor apparatus comprises a chemical sensor and/or an optical sensor for detecting the type of cleaning agent. In particular, relative to the second cleaning agent which is stored in the storage container, for example a bar code may be provided on the storage container in which the information relative to the type of second cleaning agent contained therein is encoded.

For example, the sensor apparatus detects that a special machine cleaner is filled into the supply unit as the first cleaning agent. The control apparatus deduces therefrom, for example, that the user would like to run a machine cleaning cycle. If the household dishwasher is not loaded with washing items, the control apparatus will select, propose to the user and/or run, for example, a special machine cleaning program to be run. If, however, the household dishwasher is loaded with washing items, the control apparatus will select and run, for example, the standard washing program by the use of the automatic metering apparatus. In particular, in this context it may be useful to emit user information by means of the user interface.

According to a further embodiment of the household dishwasher, the sensor apparatus is designed to detect a quantity of the first cleaning agent forming the individual dose, wherein the control apparatus is designed to compare the detected quantity with a target quantity and to run the washing program depending on the comparison.

This embodiment advantageously ensures an optimal washing result. Since the quantity of the first cleaning agent or the deviation from the predetermined target quantity is known, the control apparatus may optimally adapt the washing program, for example, relative to a quantity of water which is used for the washing cycle, a water temperature, a pump speed and/or a duration of the washing cycle.

For example, if a quantity falls below the target quantity it may be provided that the automatic metering apparatus is activated in addition to the supply unit for supplying a metering quantity of the second cleaning agent, in order to compensate for the missing quantity. Alternatively or additionally, a duration of the washing cycle may be lengthened in order to achieve a good washing result in spite of the small quantity of the first cleaning agent.

For example, if the target quantity is exceeded, a water quantity for rinsing with rinse aid may be increased in order to ensure that the first cleaning agent is fully rinsed out of the washing items.

According to a second feature, a method for operating a household dishwasher is proposed. The household dishwasher comprises a washing chamber, a control apparatus for running a washing program from a number of washing programs, a metering system comprising a supply unit for receiving an individual dose of a first cleaning agent and for supplying the individual dose into the washing chamber at a metering point in time while running the washing program and comprising an automatic metering apparatus for metering a plurality of metering quantities from a supply of a second cleaning agent provided as a solid material into the washing chamber at the metering point in time while running the washing program. In a first method step, the state of the metering system is detected by means of a sensor apparatus. In a second method step, a sensor signal is emitted depending on the detected state of the metering system. In a third method step, the washing program is run depending on the sensor signal.

This method is advantageously able to be run with a household dishwasher according to the first feature.

In particular, in the proposed method the control apparatus will dynamically adapt the washing program in order to ensure an optimal washing result. For example, this is understood to mean that parameters of the washing program to be run, in particular one or more metering points in time which are defined therein, may be changed, skipped, deleted and/or added by the control apparatus.

Moreover, a computer program product which executes the implementation of the above-described method on a program-controlled facility is proposed.

A computer program product, such as for example a computer program means, may be provided or delivered, for example, as a storage medium, such as for example a memory card, USB stick, CD-ROM, DVD or even in the form of a downloadable data file from a server in a network. This may be carried out, for example, in a wireless communication network by the transmission of a corresponding data file with the computer program product or the computer program means. The data file may only be streamed, i.e. it is not stored on the target device but directly processed.

The embodiments and features described for the proposed household dishwasher accordingly apply to the proposed method.

Further possible implementations of the invention also comprise not explicitly cited combinations of features or embodiments described above or below relative to the exemplary embodiments. In this case the person skilled in the art will also add individual features as improvements or additions to the respective basic form of the invention.

BRIEF DESCRIPTION OF THE DRAWINGS

Further advantageous embodiments and features of the invention form the subject matter of the subclaims and the exemplary embodiments of the invention described below. The invention is described in more detail below by means of preferred embodiments, with reference to the accompanying figures.

DETAILED DESCRIPTION OF EXEMPLARY EMBODIMENTS OF THE PRESENT INVENTION

Figure 1:
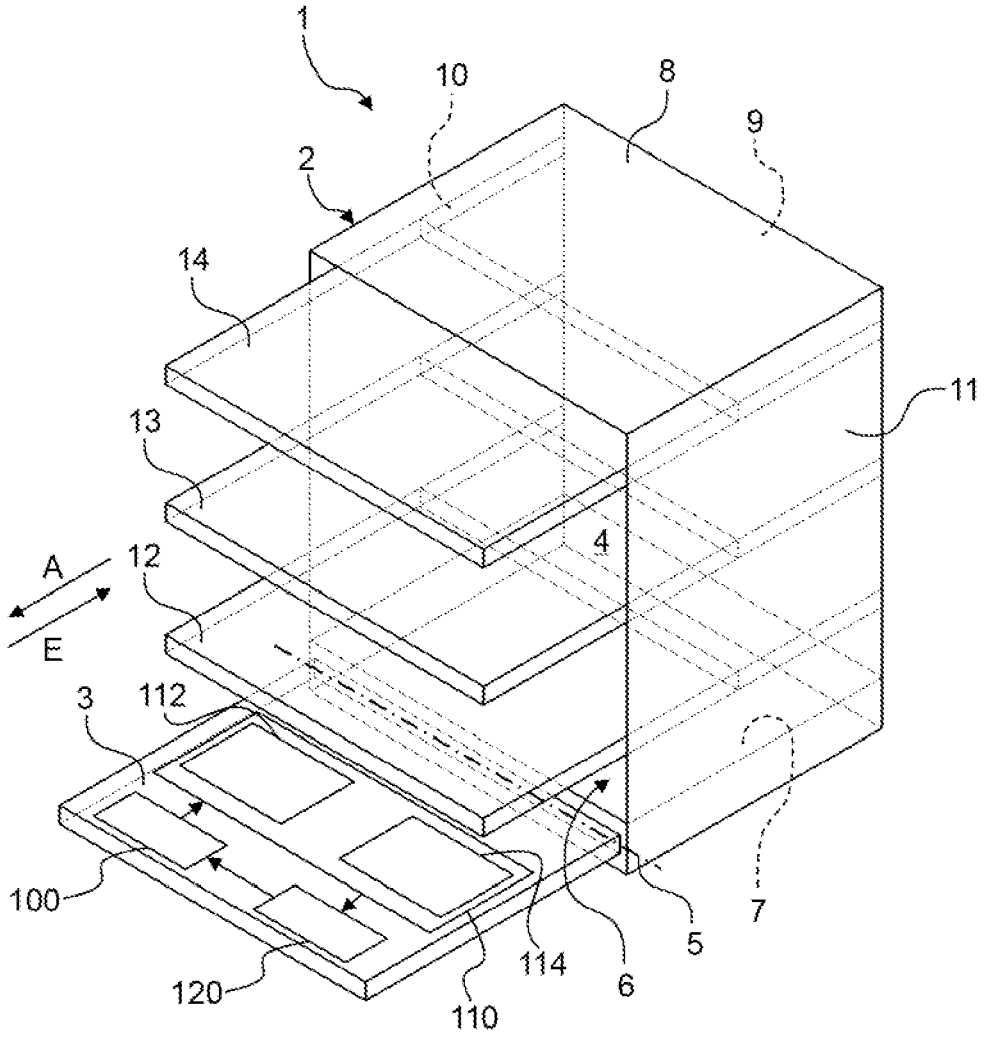
FIG. 1 shows a schematic perspective view of an embodiment of a household dishwasher.

Elements which are identical or functionally identical have been provided in the figures with the same reference characters unless indicated otherwise.

FIG. 1 shows a schematic perspective view of an embodiment of a household dishwasher 1. The household dishwasher 1 comprises a washing container 2 which is closable by a door 3, in particular in a water-tight manner. To this end, a sealing facility may be provided between the door 3 and the washing container 2. The washing container 2 is preferably cuboidal. The washing container 2 may be arranged in a housing of the household dishwasher 1. The washing container 2 and the door 3 may form a washing chamber 4 for the washing of washing items.

The door 3 is shown in the open position in FIG. 1. The door 3 may be closed or opened by pivoting about a pivot axis 5 provided at a lower end of the door 3. A loading opening 6 of the washing container 2 may be closed or opened by means of the door 3. The washing container 2 has a bottom 7, a ceiling 8 arranged opposite the bottom 7, a rear wall 9 arranged opposite the closed door 3 and two opposingly arranged side walls 10, 11. The bottom 7, the ceiling 8, the rear wall 9, and the side walls 10, 11 may be produced, for example, from a stainless steel sheet. Alternatively, the bottom 7 may be produced, for example, from a plastic material.

The household dishwasher 1 further comprises at least one receptacle for washing items 12 to 14. Preferably a plurality of receptacles for washing items 12 to 14, for example three thereof, may be provided, wherein the receptacle for washing items 12 may be a lower receptacle for washing items or a lower basket, the receptacle for washing items 13 may be an upper receptacle for washing items or an upper basket and the receptacle for washing items 14 may be a cutlery drawer. As FIG. 1 also shows, the receptacles for washing items 12 to 14 are arranged one above the other in the washing container 2. Each receptacle for washing items 12 to 14 is optionally able to be displaced into or out of the washing container 2. In particular, each receptacle for washing items 12 to 14 is able to be pushed or retracted in an insertion direction E into the washing container 2 and is able to be pulled or extended out of the washing container 2 counter to the insertion direction E in an extension direction A.

The household dishwasher 1 also has a control apparatus 100. The control apparatus 100 is configured, in particular, as a central control unit which is responsible for activating all of the controllable components or units of the household dishwasher 1.

In this exemplary embodiment, a metering system 110 which comprises a supply unit 112 and an automatic metering apparatus 114 is also arranged on the inner face of the door 3. The supply unit 112 is designed to receive an individual dose of a first cleaning agent. For example, to this end the supply unit 112 has a cavity which is closable by means of a closure element, for example a flap. The supply unit 112 is configured by the control apparatus 100 to open the flap in order to release the individual dose of the first cleaning agent contained in the cavity.

The automatic metering apparatus 114 in this example comprises a receiving unit (not shown) for receiving a removable storage container which is designed to store a second cleaning agent. The storage container receives, for example, a quantity of the second cleaning agent which corresponds to 50 metering quantities, wherein a metering quantity comprises, for example, 5 ml or even 5 g of the second cleaning agent. The automatic metering apparatus 114 also has, for example, a metering unit which is designed to meter the metering quantity of the second cleaning agent from the storage container. For example, the storage container is pivotably or rotatably arranged in the receiving unit. Alternatively, the receiving unit may be pivotably or rotatably arranged. The metering unit, for example, is thus designed to pivot or rotate the storage container in order to meter the metering quantity. For example, the metering quantity of the second cleaning agent is metered by rotating the storage container by a rotational angle of between 180°-360° in a specific rotational direction. If a quantity of the second cleaning agent which is greater than the metering quantity is desired, this may be achieved by repeated actuation of the automatic metering apparatus 114.

The household dishwasher 1 has a sensor apparatus 120 which is designed to detect a state of the metering system 110. For example, the sensor apparatus 120 has three sensors: a first sensor which is designed to detect a presence of the first cleaning agent in the supply unit 112; a second sensor which is designed to detect a type of the first cleaning agent; and a third sensor which is designed to detect a filling state of the second cleaning agent in the storage container. The state of the metering system 110 is provided in this example by all of the sensor data detected by the three sensors. The sensor apparatus 120 is also designed to emit the detected state as a sensor signal, in particular to the control apparatus 100.

The control apparatus 100 is designed to receive the sensor signal and, for example, is also designed to deduce from the received sensor signal the state of the metering system 110. The control apparatus 100 is also designed to run a washing program depending on the received sensor signal, i.e. in particular depending on the state of the metering system 110.

For example, a user loads the household dishwasher 1 with washing items and fills the supply unit 112 with an individual dose of the first cleaning agent. Then the user starts a normal washing program. The sensor apparatus 120 detects that the first cleaning agent is present in the supply unit 112 and emits the sensor signal. In the embodiments, the sensor apparatus 120 may also be designed, for example, to detect a quantity of the first cleaning agent in the supply unit 112. The control apparatus 100 starts the normal washing program. At a metering point in time of the normal washing program, which in particular is at the start of a cleaning sub-program step, the control apparatus 100 activates the metering system 110 and/or the supply unit 112, so that the individual dose of the first cleaning agent is supplied thereby into the washing chamber 4. If the quantity of the first cleaning agent is too small, for example, it may be provided that at a second metering point in time the control apparatus 100 additionally activates the automatic metering apparatus 114 for dispensing a metering quantity of the second cleaning agent. The second metering point in time may be identical to the first metering point in time but may also be after the first metering point in time.

Figure 2:
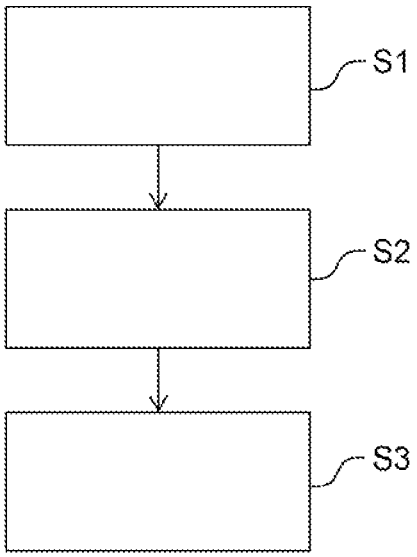
FIG. 2 shows a schematic block diagram of an exemplary embodiment of a method for operating a household dishwasher.

FIG. 2 shows a schematic block diagram of an exemplary embodiment of a method for operating a household dishwasher 1, for example the household dishwasher 1 of FIG. 1. In a first method step S1 a sensor apparatus 120 (see FIG. 1) detects a state of a metering system 110 of the household dishwasher 1. To this end, the sensor apparatus 120 may have a plurality of individual sensors. These sensors, for example, may emit an analog voltage signal, the voltage value thereof depending in a manner known per se on a measured variable, or a voltage signal which has two different levels and thus differentiates between two clearly defined states. Additionally or alternatively, the sensors may also emit a digital data signal.

In a second method step S2 the sensor apparatus 120 emits the detected state of the metering system 110 as a sensor signal. The sensor signal may comprise an analog voltage signal and/or a digital data signal. The sensor signal is designed, in particular, such that the detected state of the metering system 110 may be deduced from the sensor signal.

In a third method step S3 the control apparatus 100 (see FIG. 1) runs a washing program depending on the sensor signal. In particular, it is to be understood thereby that the control apparatus 100 receives the sensor signal and deduces therefrom the state of the metering system 110. This may be carried out, for example, by evaluating the sensor signal or scanning the sensor signal. Depending on the state of the metering system 110, the control apparatus 100 selects whether the supply unit 112 or the automatic metering apparatus 114 is to be used for the supply of cleaning agent. To this end, for example, a look-up table, in which it is predetermined which washing program is to be run in one respective state, may be stored in the control apparatus 100. Alternatively or additionally, it may be provided that the control apparatus 100 evaluates a calculation formula which outputs an optimized washing program, depending on the state. The optimized washing program may comprise, in particular, in this case individually adapted parameters such as a running time, a water quantity and/or water temperature, a target quantity of cleaning agent, one or more metering points in time for supplying the first and/or second cleaning agent, and the like.

Whilst the present invention has been described with reference to the exemplary embodiments, it may be modified in many different ways.

The invention claimed is:

1. A household dishwasher, comprising:

a washing chamber;

a control apparatus configured to run a washing program from a number of washing programs;

a metering system comprising a supply unit configured to receive an individual dose of a first cleaning agent and to supply the individual dose into the washing chamber at a metering point in time during the washing program, and an automatic metering apparatus comprising a receiving unit configured to receive a supply of a second cleaning agent, the automatic metering apparatus configured to automatically meter a plurality of metering quantities from the supply of the second cleaning agent in the form of a solid material into the washing chamber at the metering point in time; and a sensor apparatus comprising a first sensor configured to detect a presence of the first cleaning agent in the supply unit and a second sensor configured to detect a filling state of the second cleaning agent in the receiving unit, the sensor apparatus configured to detect a state of the metering system via at least the first sensor and the second sensor and to emit a first sensor signal associated with the first sensor and a second sensor signal associated with the second sensor, wherein the first sensor signal and the second sensor signal are indicative of the detected state of the metering system, wherein the control apparatus is configured to run the washing program depending on the first sensor signal and the second sensor signal.

2. The household dishwasher of claim 1, wherein the state of the metering system comprises a manual state in which the individual dose of the first cleaning agent is present in the supply unit, and an automatic state in which at least one of the metering quantities of the second cleaning agent is present in the supply and no first cleaning agent is present in the supply unit, and wherein said control apparatus is configured to activate the supply unit for supplying the first cleaning agent at the metering point in time and/or to activate the automatic metering apparatus for metering the metering quantity of the second cleaning agent when the metering system is in the manual state and to activate the automatic metering apparatus for metering the metering quantity of the second cleaning agent when the metering system is in the automatic state.

3. The household dishwasher of claim 1, further comprising a user interface configured to emit user information depending on the sensor signal.

4. The household dishwasher of claim 1, wherein the receiving unit is configured to receive a removable storage container for storing the supply of the second cleaning agent, and wherein the second sensor of said sensor apparatus is further configured to to detect a presence of the storage container in the receiving unit of the automatic metering apparatus.

5. The household dishwasher of claim 1, wherein the sensor apparatus further comprises a third sensor configured to to detect a type of the first cleaning agent and/or a type of the second cleaning agent, and wherein said control apparatus is further configured to run the washing program depending on a third sensor signal associated with the third sensor, the third sensor signal indicative of the detected type of the first cleaning agent and/or the second cleaning agent.

6. The household dishwasher of claim 1, wherein the first sensor of the sensor apparatus is further configured to detect a quantity of the first cleaning agent, and wherein said control apparatus is configured to compare the detected quantity with a target quantity for the first cleaning agent and to run the washing program depending on the comparison.

7. A method for operating a household dishwasher having a metering system which is configured to receive an individual dose of a first cleaning agent and to supply the individual dose into a washing chamber of the household dishwasher at a metering point in time during a washing program and which is configured to receive a supply of a second cleaning agent and to meter a plurality of metering quantities of the second cleaning agent in the form of a solid material into the washing chamber at the metering point in time during the washing program, said method comprising:

detecting with at least a first sensor and a second sensor of a sensor apparatus a state of the metering system, wherein the first sensor is configured to detect a presence of the first cleaning agent in the metering system, and wherein the second sensor is configured to detect a filling state of the second cleaning agent in the metering system;

the sensor apparatus emitting a first sensor signal associated with the first sensor and a second sensor signal associated with the second sensor, wherein the first sensor signal and the second sensor signal are indicative of the detected state of the metering system; and running the washing program depending on the first sensor signal and the second sensor signal.

8. A computer program product for operating a household dishwasher, said computer program product comprising a computer program embodied in a non-transitory computer readable medium, wherein the computer program, when loaded into a program-controlled facility and executed by the program-controlled facility, causes the program-controlled facility to perform the steps of:

detecting with at least a first sensor and a second sensor of a sensor apparatus a state of a metering system which is configured to receive an individual dose of a first cleaning agent and to supply the individual dose into a washing chamber of the household dishwasher at a metering point in time during a washing program and which is configured to receive a supply of a second cleaning agent and to meter a plurality of metering quantities of the second cleaning agent in the form of a solid material into the washing chamber at the metering point in time during the washing program, wherein the first sensor is configured to detect a presence of the first cleaning agent in the metering system, and wherein the second sensor is configured to detect a filling state of the second cleaning agent in the metering system;

the sensor apparatus emitting a first sensor signal associated with the first sensor and a second sensor signal associated with the second sensor, wherein the first sensor signal and the second sensor signal are indicative of the detected state of the metering system; and running the washing program depending on the first sensor signal and the second sensor signal.

* * * * *